United States Patent [19]

Albery

[11] Patent Number: 4,475,657

[45] Date of Patent: Oct. 9, 1984

[54] SUSPENSION FOLDER SUPPORT SYSTEM

[76] Inventor: Lewis L. Albery, 14429 Dante Ave., Dolton, Ill. 60419

[21] Appl. No.: 378,770

[22] Filed: May 17, 1982

[51] Int. Cl.[3] ..... B42F 17/08

[52] U.S. Cl. ..... 211/46; 211/189; 312/184; 403/172; 403/217; 403/295

[58] Field of Search ..... 211/46, 45, 189, 162, 211/195; 312/184, 183; 16/222, 228, DIG. 13; 248/DIG. 9; 403/171, 172, 176, 217, 295

[56] References Cited

U.S. PATENT DOCUMENTS

| | | | |
|---|---|---|---|
| 1,807,186 | 5/1931 | Warner | 403/172 |
| 2,336,802 | 12/1943 | Posner | 129/16 |
| 3,853,227 | 12/1974 | Filipowski | 211/162 |
| 3,860,119 | 1/1975 | Irvine et al. | 211/45 |
| 3,885,765 | 5/1975 | Richards | 248/188.1 |
| 3,999,663 | 12/1976 | Walter et al. | 312/184 X |
| 4,030,610 | 6/1977 | Alexander | 211/182 |
| 4,049,127 | 9/1977 | Alexander | 211/189 |
| 4,091,933 | 5/1978 | Alexander | 211/204 |
| 4,176,753 | 12/1979 | Godfrey | 211/182 |
| 4,262,810 | 4/1981 | Ilich | 211/206 |
| 4,283,034 | 8/1981 | Shiehan | 248/DIG. 9 |
| 4,343,135 | 8/1982 | Ilich | 53/474 |

FOREIGN PATENT DOCUMENTS

| | | | |
|---|---|---|---|
| 749287 | 7/1933 | France | 403/171 |
| 1022636 | 3/1966 | United Kingdom | 16/225 |

*Primary Examiner*—Robert W. Gibson, Jr.

*Attorney, Agent, or Firm*—Mason, Kolehmainen, Rathburn & Wyss

[57] ABSTRACT

A suspension folder support system for placement within a file drawer includes four identical corner members that are defined by a planar web. Each corner member includes a hinge allowing a first side of the web member to be bent at a right angle to a second side. The web includes a pair of sleeves on opposite sides of and parallel to the hinge and a pair of channel members perpendicular to the hinge. Support rails and cross braces are included for insertion into the channels. Four legs or supports are also included for insertion into the sleeves. The support rails, cross braces and legs include frangible portions at spaced intervals to be broken to vary the length. The suspension file support system may be packaged in a single container including four interconnected corner members, two side rails, two cross members and four support posts.

8 Claims, 7 Drawing Figures

SUSPENSION FOLDER SUPPORT SYSTEM

BACKGROUND OF THE INVENTION

A. Field of the Invention

The present invention relates to a new and improved suspension file support system and in particular, to a suspension file support system including corner units with a flexible hinge, support rails, cross braces and legs that can be varied in length to accomodate different size files.

B. Description of the Prior Art

Suspension files are versatile and useful since they are easily held in position in file drawers and may be moved or the contents emptied without removing the file from the drawer. It is desirable to convert existing file drawers to contain suspension files and a collapsible suspension file support system is desirable to allow removal of the system from a drawer for storage or transfer to another location. To meet the demand for suspension files, several systems have been proposed. The typical system requires upper and lower cross pieces to insure rigidity not provided by other components of the system. Examples of such systems are U.S. Pat. Nos. 4,049,127; 4,176,753; 3,853,227; 2,336,802; 4,091,933; 3,860,119; and 4,262,810. The extra cross piece increases the cost and complexity of the system.

In an attempt to obtain rigidity in the support system without an extra cross piece, complex and cumbersome corner members have been proposed. Corner members of this type require threading of supports into the corner member or latches to hold supports. An example of such a system is illustrated in U.S. Pat. Nos. 4,030,610 and 3,885,765. This support system is expensive to manufacture and difficult to assemble requiring the use of tools. Complex packages and packaging techniques are also required increasing the cost to package and store these systems.

Other prior art support systems must be manufactured in two different sizes to accommodate either legal or letter size folders, requiring the seller to stock both sizes.

SUMMARY OF THE INVENTION

An object of the present invention is to provide a new and improved suspension file support system.

Another object of the present invention is to provide a new and improved suspension file support system that includes a minimum number of components.

A further object of the present invention is to provide a new and improved suspension file support system that may be easily packaged and includes support members of variable length to accommodate different size file drawers.

A still further object of the present invention is to provide a new and improved suspension file support system including identical corner members each of which may be fabricated as a planar web with a highly flexible hinge allowing the corner member to be bent to conform to the configuration of a drawer.

Briefly, the present invention is directed to a new and improved suspension file support system that includes four identical corner members each with an integral flexible hinge defined by a reduced thickness. Each corner member includes a pair of channel members and a pair of sleeves into which support rails, cross braces and legs or supports may be positioned. The support system is assembled into a rectangular parallelepiped configuration that may be easily positioned within a file drawer to support suspension files. The support rails, cross braces and legs include frangible portions to be broken to adjust the lengths thereby allowing the support system to accommodate either legal or letter size files. The corner members are molded in planar strips of four connected at edges thereof allowing the corner members to be packaged in a flat container with a sufficient number of support rails, cross braces and legs for use in either letter or legal size file drawers.

BRIEF DESCRIPTION OF THE DRAWINGS

The above and other objects and advantages and novel features of the present invention will become apparent from the following detailed description of a preferred embodiment of the invention illustrated in the accompanying drawings, wherein.

DESCRIPTION OF THE PREFERRED EMBODIMENT

Figure 1:
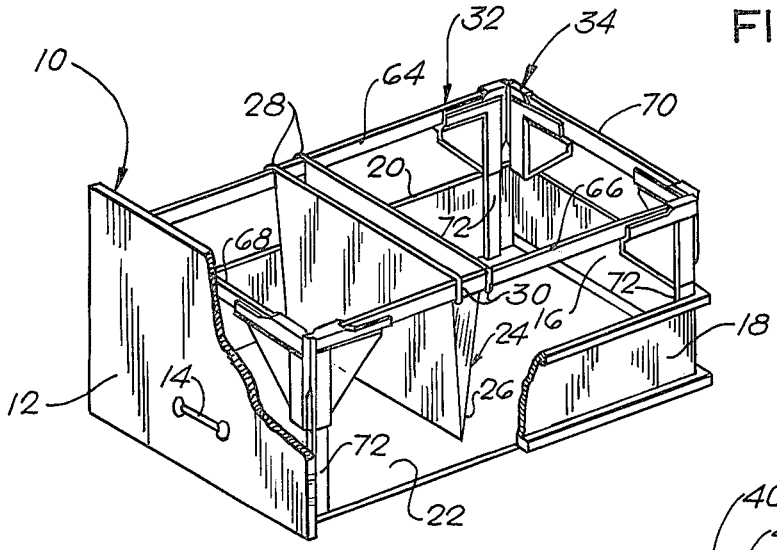
FIG. 1 is a perspective view of a file drawer within which the support system of the present invention is positioned.

Referring to the drawings, and initially to FIG. 1, there is illustrated a file drawer generally designated by the reference numeral 10 employed to store files. Drawer 10 includes a front 12 with a handle 14 for gripping to move the drawer 10 out of a file cabinet or to assist in carrying the drawer 10. The drawer 10 is rectangular in configuration with a back 16, sidewalls 18 and 20 and a bottom 22. The drawer 10 alone cannot accommodate a suspension file 24 which is a V-folder 26 with wires or rods 28 at the top with hooks 30. To mount the suspension file 24 in the drawer 10, a suspension file support system generally designated by the reference numeral 32 may be employed. The suspension file support system 32 includes two components; a corner member generally designated by the reference numeral 34 and frame members.

Figure 5:
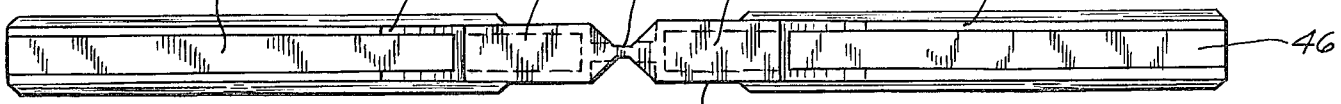
FIG. 5 is a top plan view of the corner member of FIG. 3.
Figure 3:
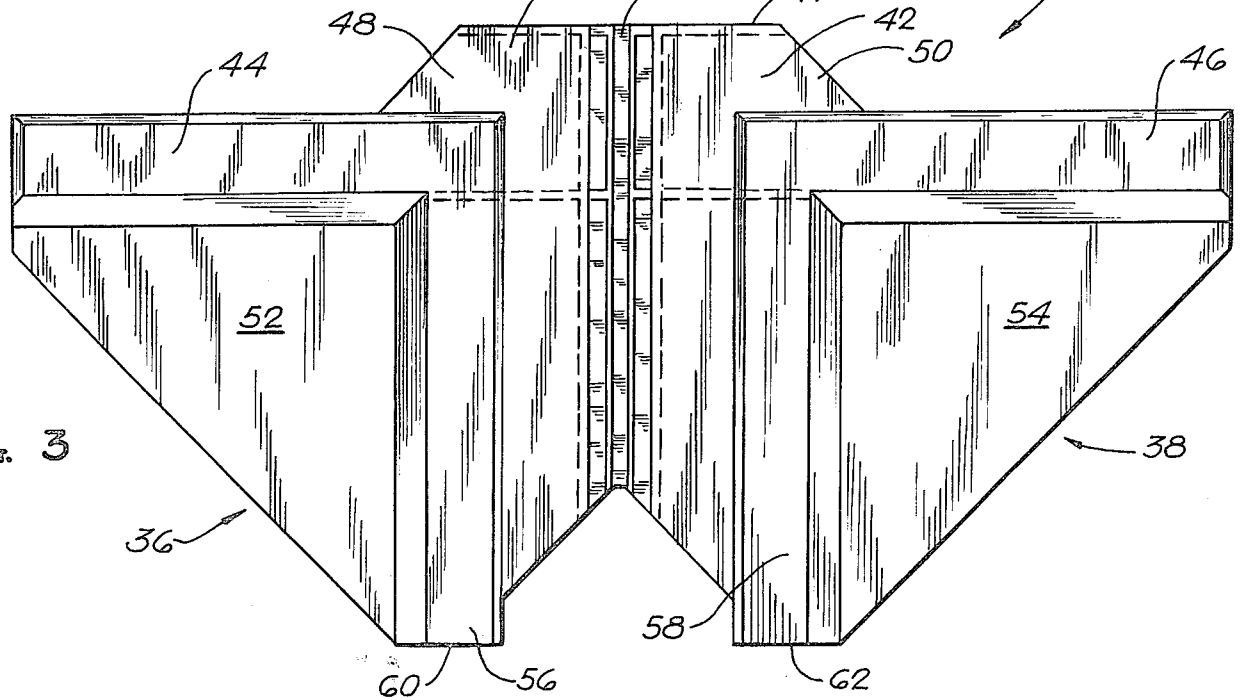
FIG. 3 is an enlarged view of a corner member.
Figure 4:
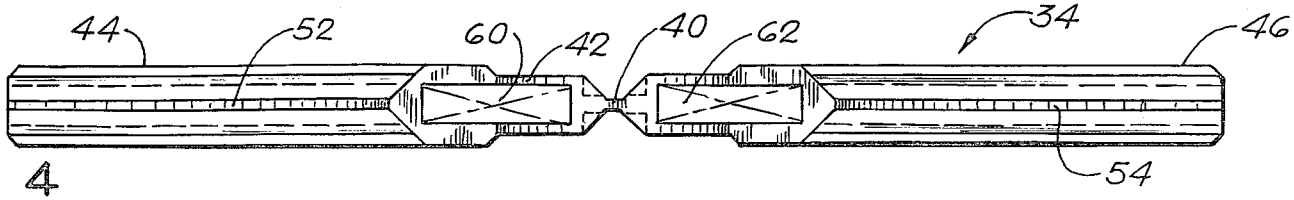
FIG. 4 is a bottom plan view of the corner member of FIG. 3.

As best illustrated in FIG. 3, the corner unit or member 34 is a molded, planar web fabricated from a resilient material, such as polyethylene. The corner unit 34 includes first side 36 and an identical second side 38 with an integral flexible hinge 40 between the sides. The hinge, as best seen in FIGS. 4 and 5, comprises a reduced thickness portion of the web. It has been found that a thickness of approximately 0.01 inch is satisfactory in providing a hinge that is flexible yet resistant to tearing or breaking despite repeated flexing. Flexibility of the hinge 40 allows the corner unit 34 to be placed in a corner of the drawer 10 with the sides 36 and 38 at a right angle.

Figure 2:
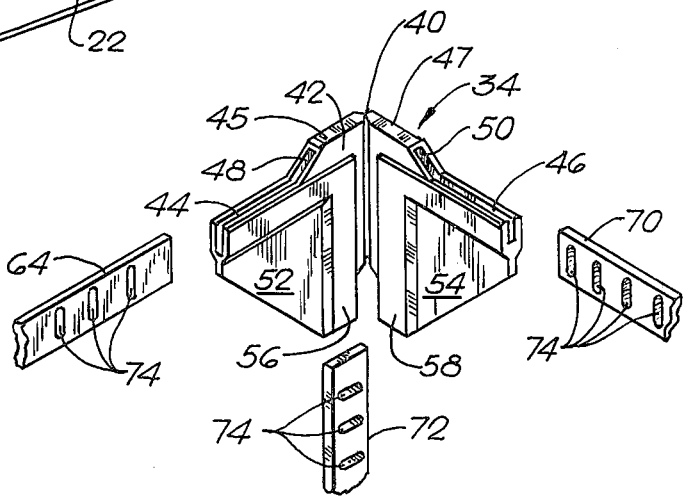
FIG. 2 is an enlarged perspective view of a corner member and support members for the support system of the present invention.

The hinge 40 is defined in an intermediate web 42 of the corner unit 34. Integrally defined on the intermediate web 42 extending along a line perpendicular to the hinge 40 are a pair of channels 44 and 46. The channels 44 and 46, as best seen in FIG. 2, are U-shaped and open at the top except for cover portions 45 and 47 over the inner end of each channel. Forward of each cover portion 45 and 47 is an inclined edge 48 and 50, respectively, allowing insertion of an end of a frame or support member into channels 46 and 48 with the cover portions 45 and 47 preventing lifting of the support member out of the channels 46 and 48 after full insertion is completed.

Each corner unit 34 further includes connecting web portions 52 and 54 that extend between the channel portions 44 and 46 to molded sleeves 56 and 58. Sleeves 56 and 58 include open lower ends 60 and 62, respectively, allowing the insertion of support or frame members. Support members positioned within sleeves 56 or 58 may be held by friction, or if desired, by other means such as gluing.

The corner unit 34 constructed as illustrated and described above, although flexible is sufficiently rigid to prevent movement of the support system 32 once assembled. Rigidity of the system 32 is also provided by support or frame members that include two support rails 64 and 66 on which the folders 24 are suspended, two cross braces 68 and 70 that provide transverse stability and rigidity and four supports or legs 72 on which the support system 32 is mounted. The frame members 64, 66, 68, 70 and 72 are preferably of the same configuration and fabricated from the same material which may be metal or rigid plastic that is molded or extruded in desired lengths. Each frame member 64, 66, 68, 70 and 72 includes several spaced indentations or apertures 74 at each end to define spaced, frangible portions allowing the user to break the frame member at a particular aperture 74 to adjust the length in accordance with the size of the drawer. Other structure defining frangible points in the frame members may be used such as cut lines. The cross brace members 68 and 70 may be fabricated in lengths to accommodate legal size folders and also may be broken at the apertures 74 to a length to accommodate letter size folders. Similarly, the length of support rails 64 and 66 may be varied in accordance with the depth of the file drawer 10. The length of the supports 72 is generally uniform; however, the frangible apertures 74 may be utilized to vary the length if desired.

To assemble the support system 32, the corner units 34 are folded along the hinges 40 such that the sides 36 and 38 are at right angles. The support rails 64 and 66 may then be placed in the channels 44 or 46 of each corner unit 34 and the cross braces 68 and 70 may be positioned in the opposite channel 44 or 46. One support 72 may be inserted in either sleeve 56 or 58 of each corner unit 34 thereby defining a rectangular parallelepiped support system 32 that may be inserted into drawer 10. Suspension files 24 may then be hung on the support rails 64 and 68 by placing hooks 30 of the rods 28 over the rails 64 and 66.

Figure 7:
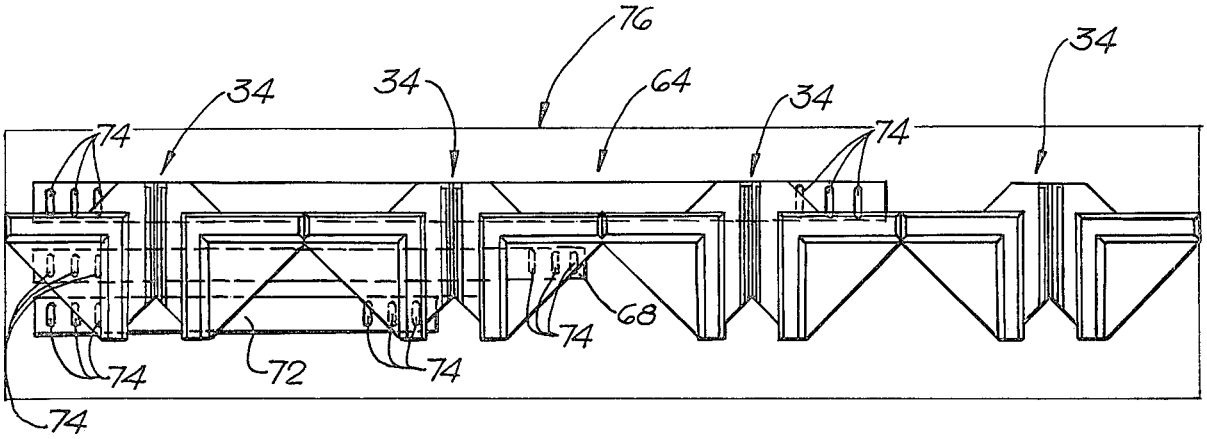
FIG. 7 is a package containing the support system of the present invention.
Figure 6:
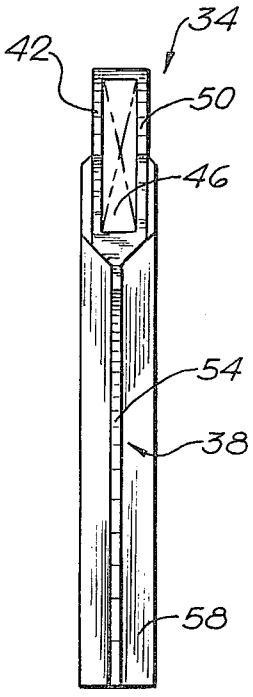
FIG. 6 is an end view of the corner member of FIG. 3.

Because the corner units 34 are identical and may lie flat, a convenient easily stored package 76 (FIG. 7) may be employed to package each support system 32. The package 76 includes four corner units 34 joined by a thin membrane of material at the ends of the channels 44 and 46. Once the package 76 is opened, the membrane may be easily torn to separate the corner units 34 from each other. Two support rails 64 and 66 are included in the package 76 as well as two cross braces 68 and 70 and four supports 72. It has been determined that a package 76 that could contain a support system 32 may be $\frac{1}{2}''$ by $2\frac{1}{2}''$ by 29" in size and may include a plastic bag that is easily stored and used.

Many modifications and variations of the present invention are possible in light of the above teachings. Thus, it is to be understood that, within the scope of the appended claims, the invention may be practiced other than as specifically described.

What is claimed and sought to be secured by Letters Patent of the United States is:

1. A suspension file support system, comprising:

a plurality of rigid frame members, and a plurality of corner members, each said corner member being planar with first and second sides, a flexible hinge between said first and second sides allowing said first and second sides to be bent to form a right angle whereby said corner members may be positioned in a corner of a drawer containing said suspension file support system, and means for securing said frame members to each said corner member, said securing means of each corner member including a pair of parallel sleeves and a pair of channels, each said channel perpendicular to one of said sleeves.

2. The suspension file support system claimed in claim 1 further comprising means for varying the length of said frame members including frangible portions defined at spaced intervals therein.

3. The suspension file support system claimed in claim 1 wherein said hinge is integral with said corner member and defined by a reduction in the thickness of said corner member.

4. A kit for constructing a suspension file support system, comprising:

a plurality of corner members joined together in a planar strip, each said corner member comprising a web with a reduced thickness portion defining a flexible hinge, first and second sides on said web with said hinge defined therebetween allowing said first side to be bent to a position at a right angle to said second side, each of said first and second sides including a top edge perpendicular to said hinge and a side edge parallel to said hinge, a channel in said top edge and a sleeve in said side edge, a pair of support rails, a pair of cross braces, and a plurality of supports.

5. The kit claimed in claim 4 wherein each said corner member comprises a web with a reduced thickness portion defining a flexible hinge.

6. The kit claimed in claim 4 wherein each said support rail, cross brace and support includes means for defining spaced frangible portions allowing breaking at said frangible portions to vary the length of each said support rail, cross brace and support.

7. The kit claimed in claim 4 further comprising a package for containing said strip of corner members, said support rails, said cross braces and said supports.

8. The kit claimed in claim 4 wherein each said corner member includes means for securing a support rail, a cross brace and a support thereto.

* * * * *